US006142544A

United States Patent [19]

Benzoni et al.

[11] Patent Number: 6,142,544

[45] Date of Patent: Nov. 7, 2000

[54] DEVICE FOR BALL RETRIEVAL AND STORAGE

[76] Inventors: Joseph Benzoni, 4113 Avenida de la Plata, Oceanside, Calif. 92056; William Bishop, 555 Suite B Hygeia Ave., Encinitas, Calif. 92024

[21] Appl. No.: 09/363,585

[22] Filed: Jul. 29, 1999

[51] Int. Cl.[7] ..... A63B 47/02

[52] U.S. Cl. ..... 294/19.2; 280/47.18

[58] Field of Search ..... 294/19.2; 206/315.9; 280/47.18, 17.315, 47.36, 655, 655.1; 221/185; 248/129; 414/437, 439, 440; 56/328.1; 473/460

[56] References Cited

U.S. PATENT DOCUMENTS

| | | | |
|---|---|---|---|
| 698,226 | 4/1902 | Roberts . | |
| 704,848 | 7/1902 | Minton . | |
| 721,196 | 2/1903 | Jeffreys . | |
| 2,788,630 | 4/1957 | Nisbet . | |
| 3,820,836 | 6/1974 | Seewagen et al. | 294/19.2 |
| 3,889,996 | 6/1975 | Campbell . | |
| 3,926,465 | 12/1975 | Hoagland et al. . | |
| 3,984,138 | 10/1976 | Brunner et al. . | |
| 4,412,697 | 11/1983 | Verde . | |
| 4,461,504 | 7/1984 | Perez et al. . | |
| 4,596,413 | 6/1986 | La Porte . | |
| 4,844,527 | 7/1989 | Ray . | |
| 5,086,948 | 2/1992 | Slusarz | 294/19.2 |
| 5,292,161 | 3/1994 | Green . | |
| 5,301,991 | 4/1994 | Chen et al. . | |
| 5,368,350 | 11/1994 | Ader et al. | 294/19.2 |
| 5,464,262 | 11/1995 | Madrazo . | |
| 5,507,541 | 4/1996 | Chen et al. . | |

*Primary Examiner*—Dean J. Kramer
*Attorney, Agent, or Firm*—James P. Broder

[57] ABSTRACT

A ball retrieval and storage device for retrieving balls of at least two different sizes comprising a wheeled container with rotatably attached handles attached thereto. The container is rollingly supported by two wheels on an axle, and includes a removable rack which when in place covers the container to ensure the contents remain within the container. When the removable rack is placed beneath the container, the entire device is elevated to prevent needless bending and stooping by the user. The device further comprises a retrieval opening which includes a fixed member and a movable member to provide a variable spacing between them depending on the size ball to be retrieved. The device is placed near a ball to be retrieved, tilted backward onto its wheels, rolled forward such that the ball is beneath the opening, then returned to its upright position in order to capture a ball. The angular movement of the movable member in a direction generally upwardly and away from the fixed member allows for differing sized balls to be retrieved and stored. A resilient member retracts the movable member back to its original position following capturing of a ball. The device further comprises a pliable cover which wraps around the sides of the container to prevent inadvertent exiting of the retrieved balls.

22 Claims, 3 Drawing Sheets

DEVICE FOR BALL RETRIEVAL AND STORAGE

BACKGROUND OF THE INVENTION

Since its inception in the mid-1800's, the sport of baseball has become increasingly popular not only in the United States, but in other countries such as Japan as well as areas of the Dominican Republic and Cuba, to name just a few. Baseball players now begin playing tee-ball at a very young age, followed by Little League, high school and collegiate level ball, and ultimately, professional leagues.

In addition, softball has likewise become more prevalent in recent years given the increased involvement of women in sports. Although softball has also long been known as a recreational activity, nearly all high schools and colleges have competitive teams today, increasing the demand for appropriate sporting equipment and accessories. Due to the growing worldwide popularity of baseball and softball, the need has arisen for a device for gathering and storing baseballs and softballs in such a manner which would avoid the constant bending which is necessary to collect such balls from the ball fields.

The present invention is directed toward the retrieval of balls from the ground without having to strain one's back by repeatedly stooping over and placing the balls into a bucket or some other archaic collection means. The current invention can be used for both compressible and incompressible balls. The device in its preferred embodiment also rollingly carries and stores a substantial number of incompressible balls which typically weigh significantly more than compressible balls such as tennis balls. The invention may further be used to gather balls of differing sizes, without any adjustment to the device. This feature of the invention is particularly useful at batting practice cages, where both softballs and baseballs are utilized simultaneously in the same general area.

The invention permits a user to collect balls by tilting the device forward or backward and placing the bottom wall of the container over one or more balls, then returning the device to its upright position. This motion causes the ball to press against a movable bottom member in a manner to allow the initial spacing between the movable member and an adjacent fixed member to increase to the point where the ball may enter the container. Once inside the container, a biasing means, also referred to as a resilient member, returns the movable member to its original position, thereby retaining the captured ball in the container. One embodiment of the invention permits the user to retrieve more than one ball during each such tilt-upright process. A further embodiment of the invention allows the device to be rollingly pulled or pushed, using the handle which is attached to the container, to the next ball or group of balls to be retrieved, where the above-described process is repeated.

In the preferred embodiment of the invention, the resilient member is an elastic strap, such as a bungee-cord material, which may be tightened or loosened depending on the size and/or weight of the balls to be retrieved and stored. The resilient member may also consist of a rubberized material which has similar stretching properties as an elastic material. Further, the preferred embodiment includes a cover of pliable material which is wrapped around the sides of the container to prevent balls from inadvertently being forced through the sides of the container due to the weight of the retrieved balls. The cover may be constructed of fabric, nylon or any other flexible material, which may then be imprinted with a team logo or other identifying insignias if the user so desires.

Additionally, the preferred embodiment includes a removable rack which fits over the open top of the container, thereby serving at least three purposes: (1) to allow placement of other equipment on top of the container during storage; (2) to act as a rack for baseball and softball bats which fit between the horizontal cross members of the rack; and (3) to retain the contents of the container without concern for spillage during storage or transport of the container. Moreover, a further embodiment permits the removable rack to be placed beneath the container, thereby elevating it above the ground for easier, more convenient use during batting and/or fielding practice.

For the foregoing reasons, there is a need for a ball retrieval device which is capable of retrieving different size balls, as well as retrieving substantially incompressible balls such as baseballs and softballs.

SUMMARY

The present invention is directed to a ball retrieval and storage device which satisfies the need for retrieving different size balls, as well as retrieving substantially incompressible balls such as baseballs and softballs. The invention generally includes a wheeled container for storing balls, and an opening at the bottom of the container through which balls are retrieved into the container. The opening includes a fixed horizontal member and a movable horizontal member generally parallel to the fixed member. The movable member slides in at least one track for guided travel in a direction which is generally away from and upward into the container upon exertion of pressure against the movable member by a ball to be retrieved. A further embodiment of the invention includes a handle which, in one embodiment of the invention, comprises two separate members which are pivotally attached to the top of opposing container sides for pushing, pulling or carrying the container to the desired location during use.

To use the device, the container is rolled up to a ball, tilted backward onto its wheels, and the bottom of the container is then placed onto the ball thereby causing the movable member to move in the track generally angularly away from the fixed member. Once the spacing between the movable member and the fixed member has increased to a distance equal to the diameter of the ball, the ball is able to enter the container. Upon entry of the ball into the container, the movable member is resiliently retracted thereby decreasing the spacing between the movable member and the fixed member to a distance which is less than the diameter of the retrieved ball, ensuring the retrieved ball will not exit the container. The angular movement of the movable member permits differing sized balls, such as baseballs and softballs, to be gathered without the necessity for any adjustment of the device. The resilient member which retracts the movable member to its resting position is comprised of an elastic band or other resilient material which generally wraps from one end of the movable member, around the outside of the container in the direction of the fixed member, to the other end of the movable member. Although the device may be used for both compressible and substantially incompressible balls, the invention is particularly suited to retrieval of baseballs and softballs of a relatively incompressible nature.

In order to keep retrieved balls from inadvertently exiting the container through spaces in the container sides, one embodiment of the invention includes a flexible material which wraps completely around the container sides, extending from the container top to the container bottom. This wrap may be comprised of fabric, nylon, plastic, canvas or other like material, and may be imprinted as desired with a team logo, insignia or other identifying markings.

A further embodiment of the invention includes a removable top rack which comprises a generally flat top slotted surface and a plurality of legs extending downward from the top surface. The rack, when in place, acts not only to generally enclose the container to prevent spillage of the container contents, but further serves as a rack for baseball and softball bats, or other appropriate sporting equipment. Further, an equipment bag may be placed on top of the rack and will generally be held in place during transport, being partially enclosed by the handles when such handles are rotated upward and toward each other for use in moving the device from one location to another.

Removal of the rack from the container top and placement of the rack beneath the container bottom results in elevating the container above the ground for more convenient use of the container during batting or fielding practice, thereby eliminating the constant bending and stooping to pick up balls which is inherent during participation in such activities.

These aspects of the invention, as well as other features and advantages, will be described in the detailed description as well as the drawings which help to more fully describe the retrieval and storage device.

DETAILED DESCRIPTION OF THE INVENTION

Figure 1:
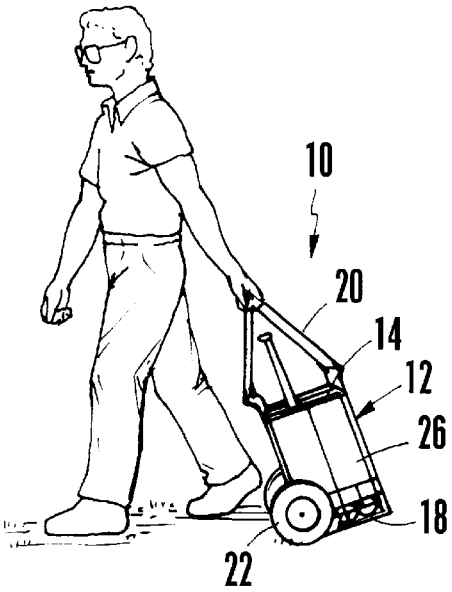
FIG. 1 is a perspective view of the preferred embodiment of the retrieval and storage device with handles in the upright position for movement of the device.
Figure 4:
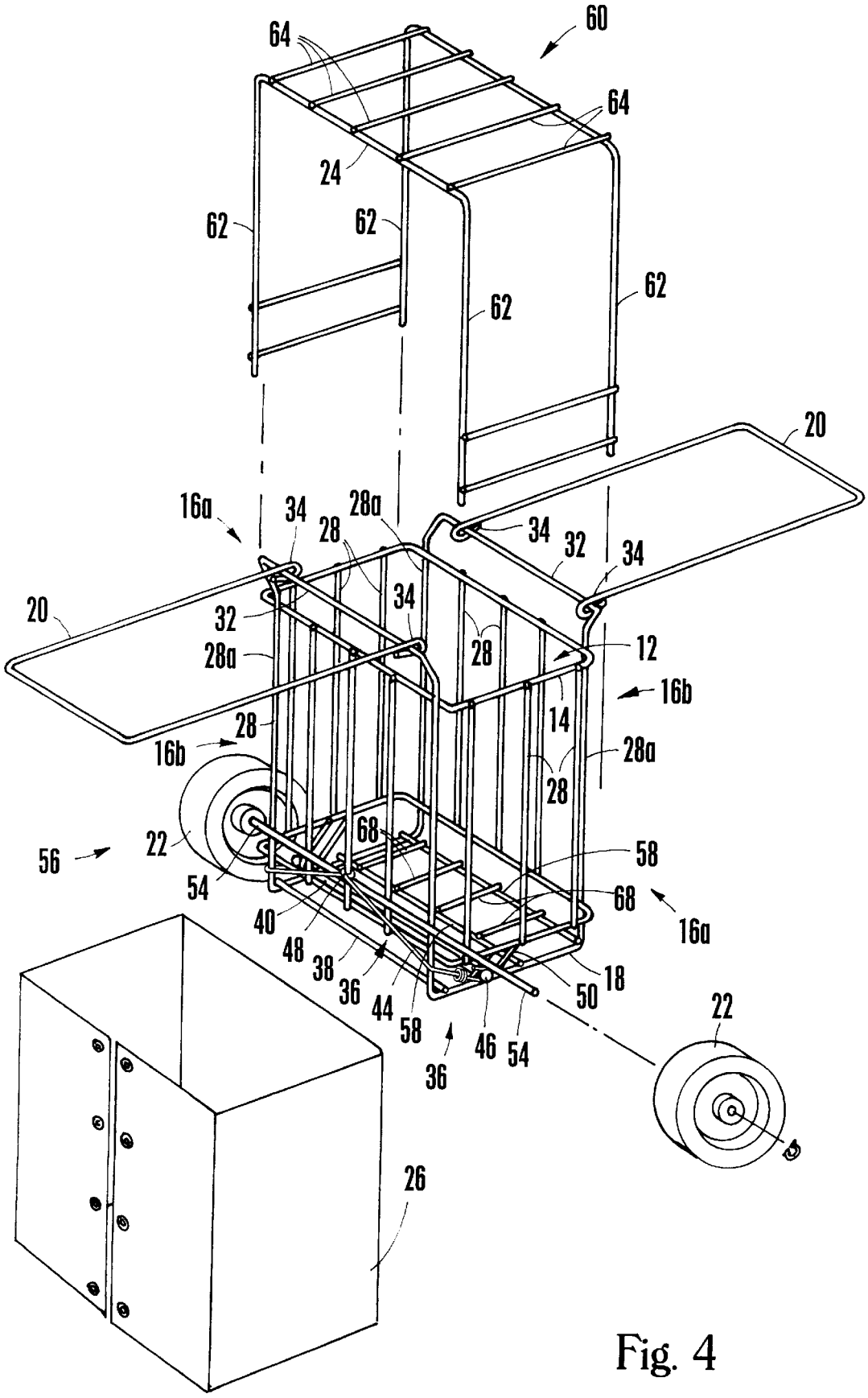
FIG. 4 is an exploded view of the preferred embodiment of FIG. 1 illustrating how the removable rack is placed over the container top, and further illustrating the wrap which fits around the container sides.

FIG. 1 of the drawings shows the preferred embodiment of the ball retrieval device 10 (hereinafter "the device"). FIG. 4 depicts an exploded view of the device, including a container 12 with an open top 14, four sides 16, and a bottom wall 18. The device further includes a pair of handles 20, a pair of wheels 22, a removable lid 24, and a cover 26 which fits around the sides 16. The container 12 is made of any suitable material, preferably steel rod. The container 12 is of generally rectangular cross-section, and includes a first pair of opposite side walls 16*a* and a second pair of opposite side walls 16*b*, both of which are defined by a plurality of vertically spaced side members 28 which extend from the open top 14 downward to a generally rectangular element referred to as a support guide support member to 30 adjacent to the bottom wall 18 of the container 12. The open top 14 is fixed to the container sides 16, the container sides 16 are fixed to the support guide support member 30.

Figure 2:
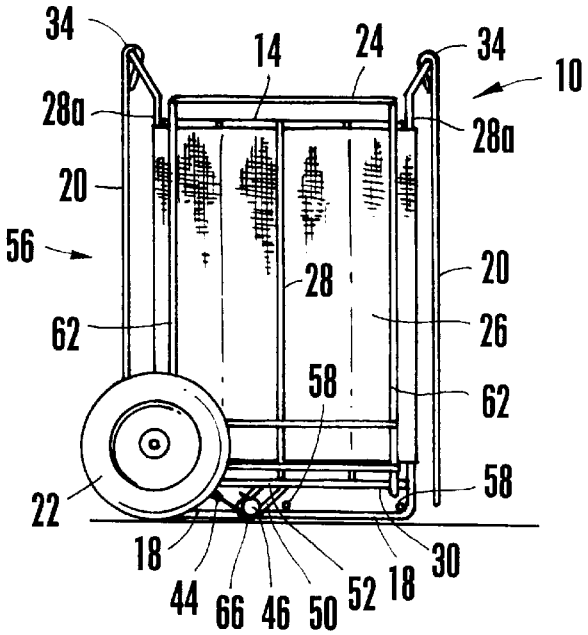
FIG. 2 is a side elevation view of the device of FIG. 1 with the handles in the downward position.
Figure 3:
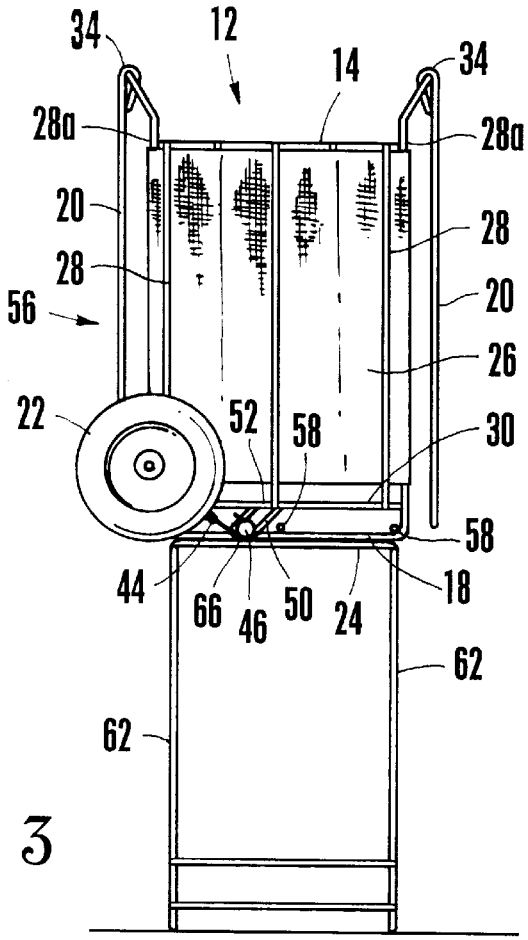
FIG. 3 is a side elevation view of the device of FIG. 1 with the removable rack positioned beneath the container of the device serving to elevate the container above the ground level.

In the preferred embodiment, the second pair of opposite side walls 16*b* include a generally horizontal handle attachment member 32 on each opposing side wall 16*b*. The handle attachment members 32 are fastened to, or preferably are an extension of, vertical corner members 28*a* which extend upwardly from the bottom wall 18, attach adjacent to each corner of the generally rectangular open top 14, and continue past the open top 14 to ultimately attach to the handle attachment members 32. In the preferred embodiment, each handle 20 is generally U-shaped, and is rotatably mounted at two handle attachment locations 34 to each of the horizontal handle attachment members 32, said handles 20 pivoting between an upwardly extending, deployed position as shown in FIG. 1, or in a downwardly extending, storage position as shown in FIGS. 2 and 3. In the deployed position, the handles 20 comprise means for carrying, pushing or pulling the container 12, and further comprise means for holding the removable lid 24 in place during transport of the device. The handles 20 and the handle attachment member 32 are made of any suitable material, preferably steel rod.

Figure 5A:
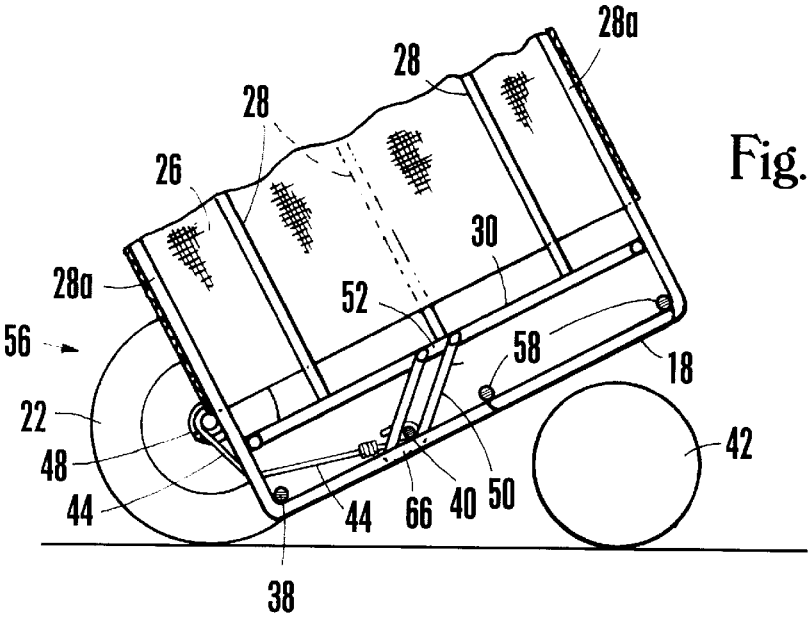
FIG. 5A is a side sectional view of the device of FIG. 1 with a ball shown to illustrate how the device is tilted backward prior to retrieving the ball.
Figure 5B:
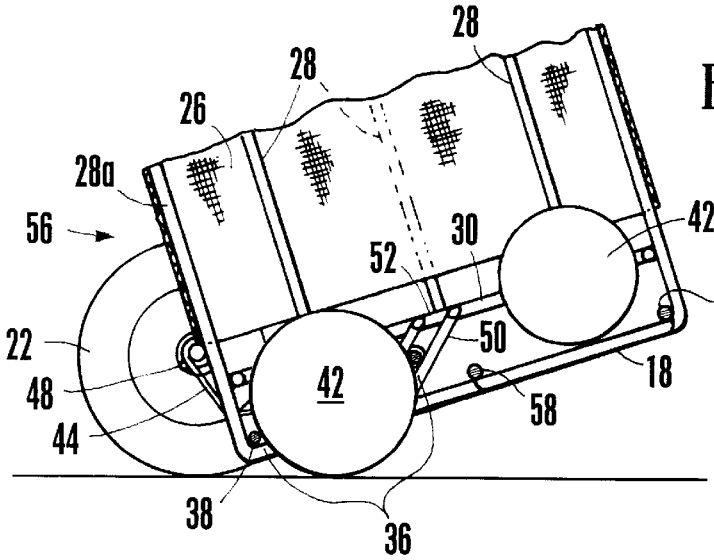
FIG. 5B is a side sectional view of the device in FIG. 1 with two balls of varying size shown, the smaller of which has been captured in the container, and the larger ball illustrating how a ball enters the container between a fixed member and a movable member.
Figure 5C:
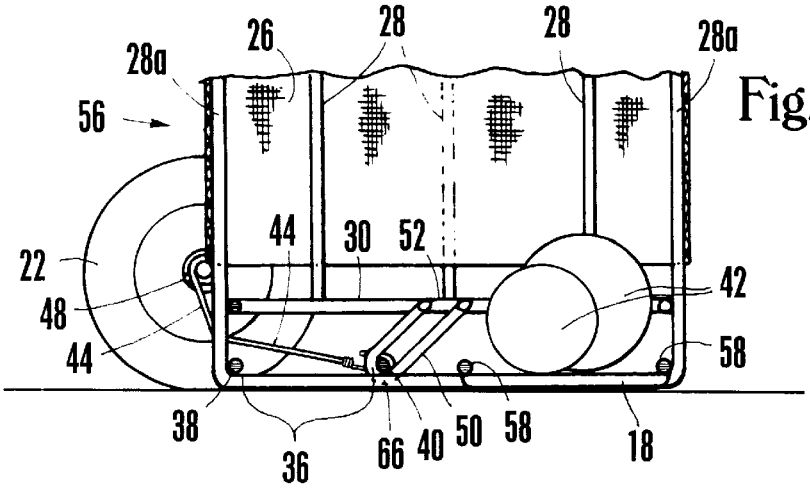
FIG. 5C is a side sectional view of the device in FIG. 1 with two balls of varying size shown inside the container, and the movable member in its fully retracted position.

The bottom wall 18 comprises an opening 36 of variable size for receiving balls of different diameters in a range from a predetermined minimum diameter to a predetermined maximum diameter. The bottom wall 18 includes at least one fixed horizontal member which in one version of the invention is referred to as a first cross bar 38 which defines one fixed side of the opening 36, and further includes a movable member also referred to as a second cross bar 40 which defines an opposite side of the opening 36. The second cross bar 40 is movable between a first position at a first predetermined spacing, said first spacing defined as a distance which is less than a diameter of a smallest ball to be retrieved by the device, from the first cross bar 38 and a second position at a second predetermined spacing, said second spacing defined as a distance greater than a diameter of a largest ball to be retrieved by the device, from the first cross bar 38. FIGS. 5A and 5C depict the second cross bar 40 at the first position. FIG. 5B shows the second cross bar 40 at a location between the first position and the second position upon entry of a ball 42 having a diameter greater than the distance between the first cross bar 38 and the second cross bar 40 when the second cross bar 40 is at the first position. In order for the invention to allow retrieval of the largest ball to be retrieved of a given diameter "D", it is essential that the distance between the first cross bar 38 and the second cross bar 40 when the second cross bar 40 is at the second position (hereinafter "second predetermined spacing") exceeds diameter "D" of the ball. Retention of a smallest ball to be retrieved will occur provided the distance between the first cross bar 38 and the second cross bar 40, at a time when the second cross bar 40 is at the first position (hereinafter "first predetermined spacing"), is less than diameter "d" of the ball, preferably between the range from ¼" to ½" less than diameter "d" of the smallest ball to be retrieved.

A biasing means, also referred to in the preferred embodiment as a resilient member 44, is utilized to retract the movable member 40 to the first position. The second cross bar 40 includes two movable member opposing ends 46. The resilient member 44 includes two ends, each of which is attached to either movable member opposing end 46 as depicted in FIG. 4. The resilient member 44 remains tensioned regardless of whether the second cross bar 40 is in the first position or the second position. In the preferred embodiment, the resilient member 44 includes a central portion 48 which is secured to the container 12 adjacent to the fixed horizontal member also referred to as the first cross bar 38.

Referring to FIGS. 5A, 5B and 5C, various configurations of the invention include at least one support guide 50 for guided travel of the movable member 40 from the first position to the second position. The preferred embodiment includes two support guides 50, each having a lower end 66 secured to the bottom wall 18 at a location which provides a distance between the fixed horizontal member 38 and the lower end 66 which is less than the diameter of the smallest ball to be retrieved by the device. The support guides 50 each extend upwardly at an angle away from the fixed horizontal member 38, and are each secured to the support guide support member 30 at an upper end 52 defining a distance between the fixed horizontal member 38 and the upper end 52 which is greater than the diameter of the largest ball to be retrieved, the support guides 50 defining a travel path for the movable member 40 which extends upwardly at an acute angle away from the fixed horizontal member 38. An advantage of the device over the prior art is that due to the angular movement of the movable member 40 in the support guides 50, the weight of the retrieved balls exerts a force upon the movable member 40 which assists in returning the movable member to the first position, whereby the balls are more effectively retained in the container 12 resulting in fewer occurrences of inadvertent exiting of the balls from the container 12 through the opening 36.

Wheel means including axle means, such as wheels 22 and axle assembly 54 attached to the container 12 near the container rear end 56, movingly support the container 12 such that balls may be retrieved. To retrieve balls, the device is wheeled up to a ball or group of balls, and the device is positioned such that the container 12 is close enough to the balls such that the container 12 may be tilted backward, as in FIG. 5A, onto its wheels, and the opening 36 at the bottom wall 18 is placed directly above the ball to be retrieved. The device is then returned to its upright position as shown in FIG. 5C, causing a force by the ball 42 upon the movable member 40, whereby the movable member 40 is urged from the first position toward the second position until such time as the spacing between the fixed horizontal member 38 and the movable member 40 equals the diameter of the ball to be retrieved, whereupon the ball may enter the container 12. Upon entry of the ball 42 into the container 12, the resilient member 44 retracts the movable member 40 to the first position, thereby retaining the ball 42 in the container 12, as indicated in FIG. 5C.

Referring to FIG. 4, the bottom wall 18 includes a plurality of bottom wall members 68 which fixedly span between two bottom wall support members 58. It is essential that the spacing between the bottom wall members 68 be less than the diameter of the smallest ball to be retrieved. The removable lid also referred to in various versions of the invention as a removable top rack 24 includes a generally flat cover 60 for extending over the open top 14 of the container 12 as shown in FIGS. 2 and 4, as well as a pair of downwardly depending legs 62 extending downwardly from opposite ends of the cover 60 for engagement over the first pair of opposite sides 16*a* of the container 12. The cover 60 includes a plurality of spaced cover supports 64 which, upon mounting of the removable lid 24 over the open top 14, provide a surface for storage of a sporting equipment bag, and further provides a plurality of slots for storage of baseball or softball batting equipment, such as a plurality of bats, whereby said bats extend downward into the container 12. Upon removal of the removable lid 24 from the open top 14, and placement beneath the bottom wall 18 such that the downwardly depending legs 62 are engaging the ground, the container 12 is effectively elevated off the ground to an approximate "waist-high" height which approximates the length of the downwardly depending legs 62 for convenience of a user of the device, as illustrated in FIG. 3.

Various embodiments of the device provide use of a pliable cover 26 which is secured around the container sides 16, thereby preventing inadvertent exiting of balls through the container sides 16 between the side members 28 which may otherwise result due to the weight of the balls in the container 12. The pliable cover is woven in and out of the side members 28 to fully surround the container sides 16. The pliable cover may be made from plastic, or alternatively from vinyl, canvas, nylon, or woven material. The pliable cover 26 may be painted, imprinted or decorated as desired by the owner of the device.

The preferred embodiment of the invention permits the user to retrieve both compressible and substantially incompressible balls of varying sizes. Preferably, the device is to be used for substantially compressible balls of similar or varying sizes. Although the present invention has been described in considerable detail with reference to certain preferred versions thereof, other versions are possible. Therefore the spirit and scope of the appended claims should not be limited to the description of the preferred versions contained herein.

What is claimed is:

1. A ball retrieval device for retrieving balls of at least two different sizes, the device comprising:

a container having an open top, sides, and a bottom wall;

the bottom wall having an opening of variable size for receiving balls of different diameters in a range from a predetermined minimum diameter to a predetermined maximum diameter;

the bottom wall having at least one fixed horizontal member defining one fixed side of said opening and one movable member defining an opposite side of said opening, said movable member being movable between a first position at a first predetermined spacing from the fixed member and a second position at a second predetermined spacing from the fixed member;

the first spacing being less than said predetermined minimum diameter and the second spacing being greater than said predetermined maximum diameter;

biasing means for biasing said movable member into said first position;

whereby said movable member is urged from said first position towards said second position when said container bottom wall is urged downwardly over a ball with said opening aligned with the ball in order to enlarge said opening and allow said ball to enter said container through said opening, and is then biased back to said first position to retain said ball in said container;

wherein the container further includes a removable lid for releasable mounting over the open top of the container;

wherein the removable lid comprises a generally flat cover for extending over the open top of the container, the container being of generally rectangular cross-section and having first and second pairs of opposite side walls, the cover having opposite ends, and at least one pair of downwardly depending legs extending downwardly from opposite ends of the cover for engagement over the first pair of opposite sides of the container; and the device further comprising a pair of handles secured to the second pair of opposite sides of the container, whereby the handles comprise means for carrying the container and further comprise means for holding the removable lid in place over the open top of the container.

2. The device as claimed in claim 1, wherein said biasing means comprises a resilient member secured between said container and said movable member.

3. The device as claimed in claim 1, including a support guide for guided travel of said movable member from said first position to said second position, the support guide having a first end secured to said bottom wall and extending upwardly at an angle away from said fixed horizontal member to define a travel path for said movable member which extends upwardly at an acute angle away from said fixed member.

4. The device as claimed in claim 1, including a pair of wheels depending from a location adjacent to and upward from the fixed horizontal member of the bottom wall of said container; said wheels for movably supporting the container.

5. The device as claimed in claim 1, wherein each handle is rotatably mounted on the respective side of the container and rotatable between an upwardly extending, deployed position for gripping by a user and downwardly extending, storage position.

6. The device as claimed in claim 1, wherein the bottom wall of the container has a pair of opposite sides, the fixed member comprising a first cross bar extending between the opposite sides of the bottom wall, and the movable member comprising a second cross bar extending between the opposite sides of the bottom wall in said first position, the container having a pair of upwardly inclined tracks extending from the bottom wall, the second cross bar having opposite ends engaging in said tracks for guided movement of said second cross bar from said first position to said second position, each track having a lower end corresponding to the first position of said second cross bar and an upper end corresponding to the second position of said second cross bar, the tracks being inclined upwardly in a non-vertical direction away from said first cross bar.

7. The device as claimed in claim 6, wherein the biasing means comprises a resilient member secured between the container and second cross bar.

8. The device as claimed in claim 7, wherein the resilient member comprises an elastic band having opposite ends secured to opposite ends of said second cross bar and a central portion secured to said container adjacent said first cross bar.

9. The device as claimed in claim 1, wherein the container is an open wire framework, and including a pliable cover secured around the sides of the container.

10. A ball retrieval device for retrieving a plurality of substantially incompressible balls comprising:

a container having a top, sides and a bottom wall;

a fixed horizontal member which is secured to the container extending generally horizontally adjacent the container bottom;

a movable member with a first opposing end and a second opposing end; whereby said movable member is resiliently coupled to the container near the fixed member providing a spacing between the movable member and the fixed member, the movable member being movable in relation to the fixed member;

a support guide for supporting at least one opposing end of the movable member, the guide secured to the container for guided travel of the movable member in a direction generally away from the fixed member upon exertion of downward pressure of the container bottom onto a ball thereby allowing for sufficient spacing for the ball to enter the container;

a resilient member secured to the movable member whereby upon entry of the ball the movable member returns to a position which provides a spacing between the fixed member and the movable member which is less than the diameter of the ball upon entry of the ball into the container;

wherein the resilient member is an elastic member with a first end and a second end; whereby the first end is attached to the first opposing end of the movable member; whereby the second end is attached to the second opposing end of the movable member; whereby the elastic member courses in such a manner so as to impose a force upon the movable member in a direction generally toward the fixed member.

11. The device as claimed in claim 10, further comprising a pair of wheels attached to the container for rollingly supporting the container.

12. The device as claimed in claim 10, further comprising a handle pivotally attached to the container at the container top.

13. The device as claimed in claim 10, further comprising a removable top rack with a plurality of spaced cover supports secured to a plurality of horizontal members, and a plurality of leg members each secured to and extending vertically downward from the horizontal members whereby the top rack may be fitted over the top of the container top;

whereby the top rack when removed may be placed beneath the container thereby elevating the container above the ground level.

14. The device as claimed in claim 13, further comprising a pliable cover which is secured around the container sides.

15. A ball retrieval device for retrieving balls of at least two different sizes, the device comprising:

a container having an open top, sides, and a bottom wall;

the bottom wall having an opening of variable size for receiving balls of different diameters in a range from a predetermined minimum diameter to a predetermined maximum diameter;

the bottom wall having at least one fixed horizontal member defining one fixed side of said opening and one movable member defining an opposite side of said opening, said movable member being movable between a first position at a first predetermined spacing from the fixed member and a second position at a second predetermined spacing from the fixed member;

the first spacing being less than said predetermined minimum diameter and the second spacing being greater than said predetermined maximum diameter; and biasing means for biasing said movable member into said first position;

whereby said movable member is urged from said first position towards said second position when said container bottom wall is urged downwardly over a ball with said opening aligned with the ball in order to enlarge said opening and allow said ball to enter said container through said opening, and is then biased back to said first position to retain said ball in said container;

wherein the bottom wall of the container has a pair of opposite sides, the fixed member comprising a first cross bar extending between the opposite sides of the bottom wall, and the movable member comprising a second cross bar extending between the opposite sides of the bottom wall in said first position, the container having a pair of upwardly inclined tracks extending from the bottom wall, the second cross bar having opposite ends engaging in said tracks for guided movement of said second cross bar from said first to said second position, each track having a lower end corresponding to the first position of said second cross bar and an upper end corresponding to the second position of said second cross bar, the tracks being inclined upwardly in a non-vertical direction away from said first cross bar;

wherein the biasing means comprises a resilient member secured between the container and the second cross bar;

the resilient member having at least two opposite ends secured to opposite ends of said second cross bar and a central portion of said resilient member secured to said container adjacent the first cross bar.

16. A ball retrieval device adapted to retrieve a ball, the device comprising:

a container having a container aperture;

a movable member that moves relative to the container near the container aperture between an open position and a closed position; wherein when the movable member is in the open position, the ball can fit through the container aperture and when the member is in the closed position, the ball does not fit through the container aperture; wherein the movable member has a first end and a second end;

a support guide assembly that secures the movable member to the container, the support guide assembly guiding the movement of the movable member and allowing the first end to move at a different rate than the second end; and a biasing means that biases the movable member towards the closed position.

17. The device of claim 16 wherein the support guide assembly includes a pair of spaced-apart support guides.

18. The device of claim 17 wherein each support guide includes a pair of spaced-apart rails that guide one of the ends therebetween.

19. The device of claim 16 wherein the biasing means includes a first end and a second end, the first end of the biasing means being attached to the first end of the movable member and the second end of the biasing means being attached to the second end of the movable member.

20. The device of claim 19 wherein the biasing means includes an elastic member.

21. The device of claim 16 wherein the container includes a removable lid and a pair of spaced apart handles, wherein the handles include means for carrying the container and means for holding the removable lid in place on the container.

22. The device as claimed in claim 16 wherein the container includes an open framework and a pliable cover secured around the framework.

* * * * *